US005581879A

United States Patent [19]

Tsuji et al.

[11] Patent Number: 5,581,879

[45] Date of Patent: Dec. 10, 1996

[54] WIRE PRESS-FITTING METHOD AND APPARATUS FOR PRESSURE TERMINAL

[75] Inventors: Masanori Tsuji; Kimihiro Abe; Osamu Sugiyama; Hiroshi Yamamoto, all of Shizuoka, Japan

[73] Assignee: Yazaki Corporation, Tokyo, Japan

[21] Appl. No.: 394,957

[22] Filed: Feb. 27, 1995

[30] Foreign Application Priority Data

Feb. 25, 1994 [JP] Japan ..... 6-028273

[51] Int. Cl.[6] ..... H01R 43/04

[52] U.S. Cl. ..... 29/861; 29/33 M; 29/751; 29/753

[58] Field of Search ..... 29/33 M, 751, 29/753, 861, 566.4, 760

[56] References Cited

U.S. PATENT DOCUMENTS

| | | | |
|---|---|---|---|
| 4,027,368 | 6/1977 | Asick | 29/751 |
| 4,370,881 | 2/1983 | Peterpaul | 29/753 X |
| 4,533,193 | 8/1985 | Blackwood | 29/866 X |
| 4,870,747 | 10/1989 | Maack et al. | 29/753 |
| 5,018,269 | 5/1991 | Ishida et al. | 29/861 |
| 5,075,963 | 12/1991 | Panlenko | 29/33 M X |
| 5,099,570 | 3/1992 | Gerhard, Jr. | 29/751 |
| 5,457,876 | 10/1995 | Gerhard, Jr. | 29/566.4 X |

FOREIGN PATENT DOCUMENTS

| | | | |
|---|---|---|---|
| 61-136484 | 8/1986 | Japan | H01R 43/01 |
| 448568 | 2/1992 | Japan | H01R 43/00 |
| 433285 | 2/1992 | Japan | H01R 43/00 |

*Primary Examiner*—William R. Briggs

*Attorney, Agent, or Firm*—Sughrue, Mion, Zinn, Macpeak & Seas

[57] ABSTRACT

A wire press-fitting method for a pressure terminal wherein platelike movable holding sections are disposed along both side surfaces of a pressuring punch so as to be urged by resilient members, one end of each resilient member being supported by a press main body, and both the movable holding sections are abutted against top ends of pressuring blades in association with lowering of the press main body, so that the pressuring blades are pushed down.

6 Claims, 6 Drawing Sheets

WIRE PRESS-FITTING METHOD AND APPARATUS FOR PRESSURE TERMINAL

BACKGROUND OF THE INVENTION

The invention relates to a wire press-fitting method and apparatus for a pressure terminal adapted to connect a sheathed wire into pressuring blades of the pressure terminal by pressure.

Generally, a pressure terminal is connected as follows. A sheathed wire is pressed into the slots of platelike pressuring blades by a pressuring punch; edges of the pressuring blades cut the sheath of the wire by the pressing force, so that the conductors are exposed; and then both the edges of the pressuring blades and the conductors of the wire are pressured to establish connection providing electric conduction.

Such a wire press-fitting process consists of two steps. The first step is to insert a pressure terminal into a connector housing (hereinafter referred to as "housing"), and the second step is to connect a wire to the pressure terminal inserted into the housing by pressure.

An example of the first step, which is the step of inserting the pressure terminal into the housing, is disclosed in Unexamined Japanese Patent Publication No. Hei. 4-33285. Longitudinally catenated pressure terminals wound in a reel are inserted sequentially from the head end thereof into terminal accommodating chambers continuously from the rear toward the front of the housing, and the catenating strips are thereafter cut off.

Further, an example of the second step, which is the step of pressuring the wire into the pressure terminal within the terminal accommodating chamber, is disclosed in Unexamined Japanese Utility Model Publication Nos. Hei. 4-48568 and Sho. 61-136484. The pressure terminal inserted in the insertion process is fixed at a predetermined position, and the wire is thereafter connected to the pressure terminal by pressure.

FIGS. 9 and 10 are a perspective view and a sectional view outlining such wire press-fitting process. The whole process will be described with reference to these figures. First, a pressure terminal 105 is inserted into a housing 106 from the rear of the housing 106. The pressure terminal 105 is to be inserted as far as to the front of the housing 106. Since the pressure terminal 105 has a downwardly projecting lance 108 at the tip thereof, an appropriate clearance a is provided in an upper part of the terminal accommodating chamber 107 to receive the lance 108. The pressure terminal 105 is fixed at a correct position by a positioning tool after being inserted, and a wire 103 is then pressed into the pressure terminal 105 by a pressuring punch 104 from above, the pressuring punch being fitted into a vertically movable press main body 113.

The pressuring punch 104 pushes the wire 103 down together with the sheath of the wire 103 so that the wire 103 is pressed into slots of pressuring blades 102. At this instance, the sheath of the wire 103 is cut apart by the edges of the slots so that the conductors of the wire 103 are electrically connected to the pressuring blades 102. Since the pressuring punch 104 has releasing grooves 110 formed therein, the pressuring blades 102 are fitted into these releasing grooves 110 so that interference between the pressuring punch 104 and the pressuring blades can be avoided.

However, such conventional wire press-fitting method has encountered the problem that the pressure terminal sometimes plays inside the housing after the insertion thereof because of the clearance a provided to insert the pressure terminal into the front of the housing from the rear of the housing as shown in, e.g., FIG. 10.

As a result, in the case of performing the operation of setting the pressure terminal 105 at a predetermined position by causing the projected end of the positioning tool 111 to be abutted against the front opening of the housing 106 so that the pressure terminal 105 can be pushed back as shown in FIG. 11, the rear part of the pressure terminal 105 may, in some cases, float as shown in FIG. 11, and from this may arise incomplete connection and difficulties in connection during the wire press-fitting process.

Further, in the wire press-fitting process, if the sheath of the wire 103 is, e.g., thick or the sheathing material is relatively rigid, or the pressuring blades 102 do not function as a good cutter, then the side walls of the pressuring blades 102 may be expanded toward cavity walls 122 as shown in FIG. 12. In addition, if the pressuring blades 102 are plastically deformed so as to lose restitutive force by going beyond the elastic deformable range thereof, contact between the wire and the pressuring blades is not so adequate, which in turn makes it difficult to ensure electric contact between the conductors of the wire 103 and the pressuring blades 102.

Still further, since the expanded pressuring blades 102 cause the cavity walls 122 of the housing to be inclined, the adjacent cavity walls are affected by such inclined cavity walls. This may, in certain cases, make it impossible to connect the wire to the pressure terminal by pressure.

Hence, for the aforementioned reasons, there exist the problems such as a reduction in nondefectives in the mass production process, a limited freedom in designing due to limited kinds of material that can be used, and an elevated cost of manufacture.

SUMMARY OF THE INVENTION

The invention has been made to overcome these problems and shortcomings. Accordingly, the object of the invention is to provide a wire press-fitting method and apparatus that can reliably fix a pressure terminal at a predetermined position in a housing and thereby reliably connect a wire to the pressure terminal by pressure without deforming pressuring blades during the operation of pressuring the wire to the pressure terminal.

To achieve the above object, the invention is applied to a wire press-fitting method for a pressure terminal in which a platelike pressuring punch is fitted into a vertically movable press main body; and a wire is pressed into pressuring blades of the pressure terminal by the pressuring punch from above so that the wire is connected to the pressure terminal for electric conduction, the pressure terminal being inserted into a housing. Such wire press-fitting method for a pressure terminal is characterized in that platelike movable holding sections are disposed along both side surfaces of the pressuring punch so as to be urged by resilient members, one end of each resilient member being supported by the press main body, and that both the movable holding sections are abutted against top ends of the pressuring blades in association with lowering of the press main body, so that the pressuring blades are pushed down.

To achieve the above object, the invention is also applied to a wire press-fitting method for a pressure terminal wherein a platelike pressuring punch is fitted into a vertically movable press main body; and a wire is pressed into pressuring blades of the pressure terminal by the pressuring punch from above so that the wire is connected to the pressure terminal for electric conduction, the pressure terminal being inserted into a housing. Such wire press-fitting method for a pressure terminal is characterized in that not only platelike movable holding sections are disposed along both side surfaces of the pressuring punch so as to be urged by resilient members, one end of each resilient member being supported by the press main body, but also projections arranged on outer sides of bottom ends of the movable holding sections are engaged with stepped portions arranged on top ends of the pressuring blades of the pressure terminal in association with lowering of the press main body, so that the pressuring blades can be pushed down and expansion of the pressuring blades can be prevented.

To achieve the above object, the invention is also applied to a wire press-fitting apparatus for a pressure terminal, comprising a pressure main body which is vertically movable, a platelike pressuring punch held in an opening of the press main body with a retaining shaft, the pressuring punch having in a bottom end thereof a horizontally extending long groove serving as a surface of abutment against a wire, platelike movable holding sections disposed along both side surfaces of the pressuring punch so as to be urged by resilient members, one end of each resilient member being supported by the press main body, wherein both the movable holding sections are abutted against the pressuring blades in association with lowering of the press main body, so that the pressuring blades are pushed down.

To achieve the above object, the invention is also applied to a wire press-fitting apparatus for a pressure terminal, comprising a press main body which is vertically movable, a platelike pressuring punch in an opening of the press main body with a retaining shaft, the pressuring punch having in a bottom end thereof a horizontally extending long groove serving as a surface of abutment against a wire, platelike movable holding sections disposed along both side surfaces of the pressuring punch so as to be urged by resilient members, one end of each resilient member being supported by the press main body. The apparatus further comprises arranged on outer sides of bottom ends of the movable holding sections; and stepped portions, arranged on top ends of the pressuring blades of the pressure terminal, to be engaged with said projection in association with the lowering of the press main body, so that not only the pressuring blades can be pushed down but also expansion of the pressuring blades can be prevented.

The wire press-fitting methods and apparatuses for a pressure terminal of the invention have the following two functions.

1) The wire press-fitting method and apparatus for a pressure terminal of the invention as recited in claims 1 and 3 are characterized as pushing the pressuring blades down with the movable holding sections, disposed on both sides of the pressuring punch, being abutted against the top ends of the pressuring blades in association with lowering of the press main body prior to the process of pressing the wire into the pressuring blades by the pressuring punch. This function of exerting the pushing force on the pressuring blades is performed by the movable holding sections over the whole wire press-fitting process. As a result, not only incomplete connection and playing of the pressure terminal due to a part of the pressure terminal floating or the like can be prevented, but also highly reliable, stable press-fitting process can be implemented.

2) The wire press-fitting method and apparatus for a pressure terminal of the invention as recited in claims 2 and 4 are characterized as engaging the projections of the movable holding sections with the stepped portions arranged on the top ends of the pressuring blades with the movable holding sections disposed on both sides of the pressuring punch being abutted against the top ends of the pressuring blades in association with lowering of the press main body prior to the process of pressing the wire into the pressuring blades by the pressuring punch. Therefore, not only do the movable holding sections push the pressuring blades down, but also they prevent the expansion of the pressuring blades. As a result, the outward expansion of both side walls of the pressuring blades can be checked, and therefore the conductors exposed from the wire can be in contact with the pressuring blades, thereby providing reliable electric conduction.

DETAILED DESCRIPTION OF THE PREFERRED EMBODIMENTS

Wire press-fitting methods and apparatuses for a pressure terminal, which are embodiments of the invention, will now be described with reference to FIGS. 1 to 8.

Figure 1:
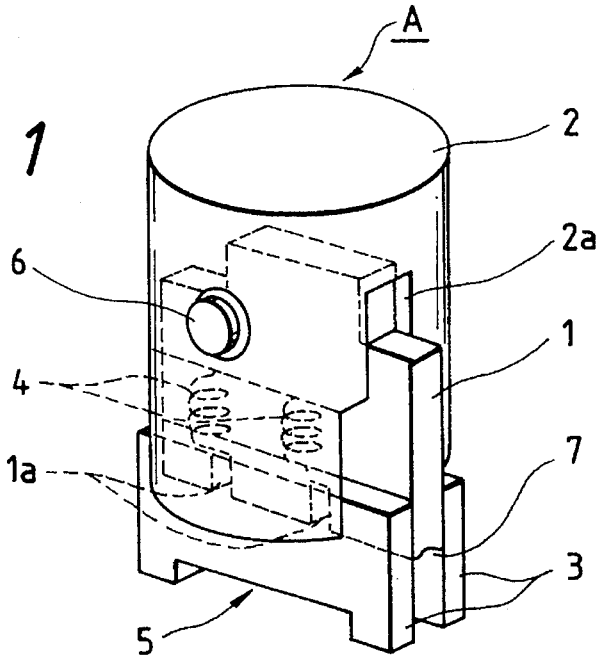
FIG. 1 is a perspective view of a wire press-fitting apparatus, which is a first embodiment of the invention.
Figure 2:
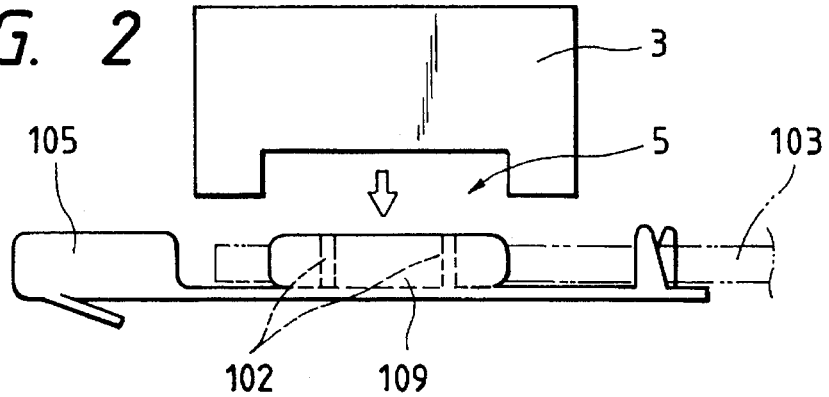
FIG. 2 is a diagram illustrative of an operation of a movable holding section in FIG. 1.
Figure 4:
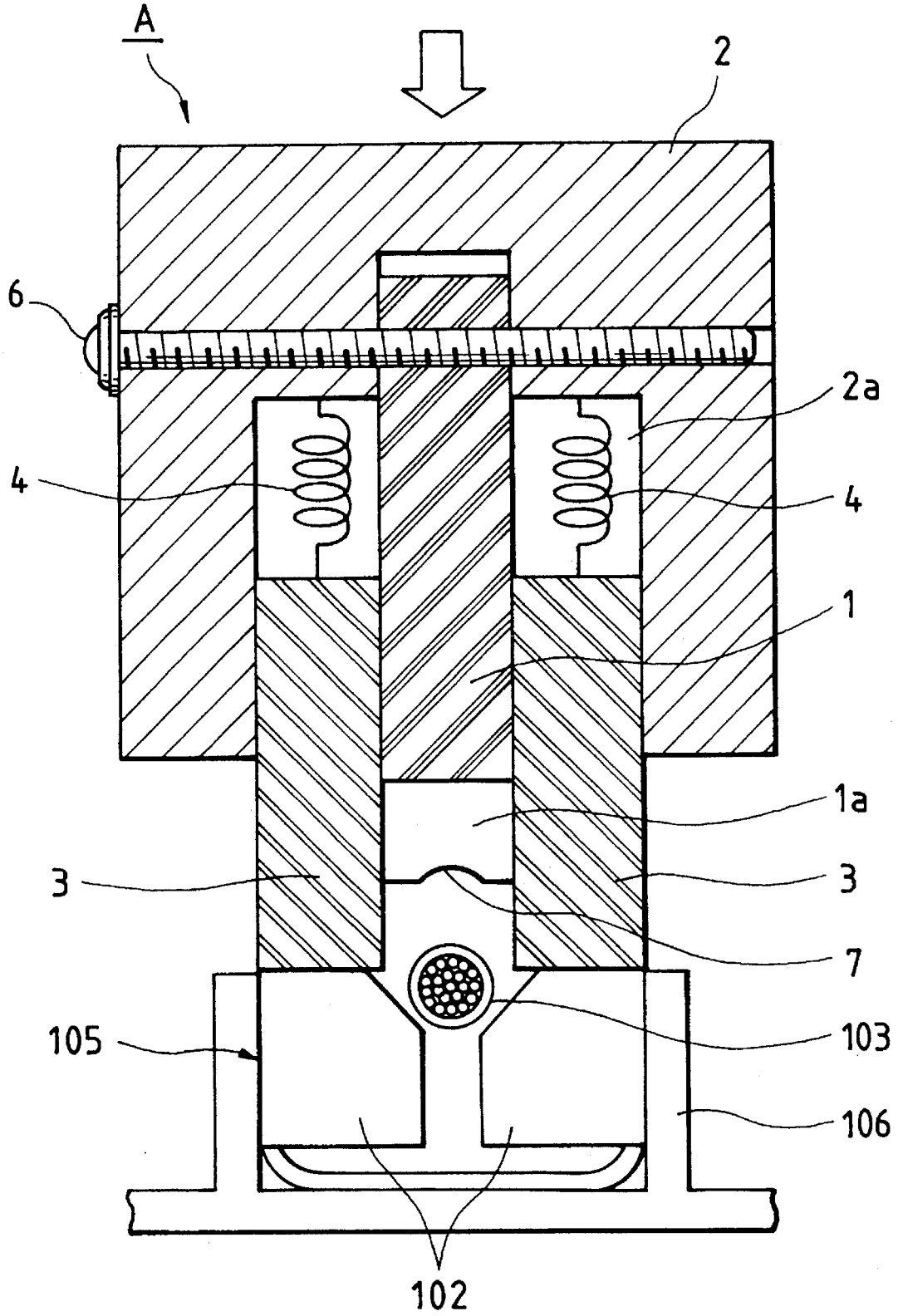
FIG. 4 is a diagram illustrative of an operation before a wire is pressured by the apparatus shown in FIG. 1.
Figure 5:
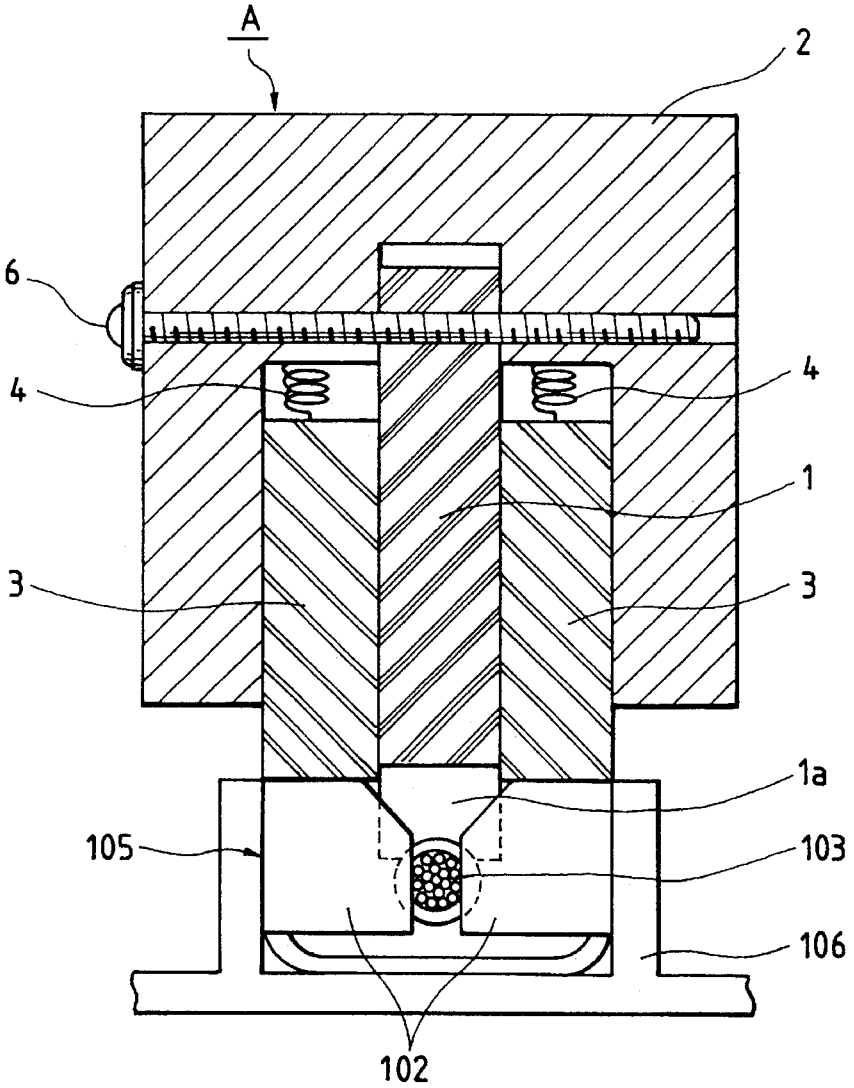
FIG. 5 is a diagram illustrative of an operation after the wire is pressured by the apparatus shown in FIG. 1.

A first embodiment of the invention will be described first with reference to FIGS. 1, 2, 4, and 5. FIG. 1 is a perspective view of a wire press-fitting apparatus, which is the first embodiment of the invention; FIG. 2 is a diagram illustrative of an operation of a movable holding section in FIG. 1; FIG. 4 is a diagram illustrative of an operation before a wire is pressured by the apparatus shown in FIG. 1; and FIG. 5 is a diagram illustrative of an operation after the wire is pressured by the apparatus shown in FIG. 1.

As shown in FIG. 1, a press main body 2 of a wire press-fitting apparatus A is cylindrical in shape with a vertically extending notched groove therein, and has a pressuring punch 1 and movable holding sections 3. The pressuring punch 1 projects from a side opening 2*a* and bottom opening of the press main body 2, and the movable holding sections 3 interpose the pressuring punch 1 therebetween.

The press main body 2 is connected to an automatic press and a manual lever type pressure connecting tool so as to be vertically movable. The pressuring punch 1, which is platelike, is fitted into the press main body 2 with a retaining shaft 6 inserted into an insertion hole (not shown) in an upper portion thereof. The pressuring punch 2 also has a pair of vertically extending grooves 1*a* at the bottom end thereof and further a long horizontally extending groove at the lower edge thereof.

The two confronting platelike movable holding sections 3, 3 are disposed so as to extend along both side surfaces of the pressuring punch 1 and are urged downward by a plurality of resilient members 4, one end of each resilient member 4 being supported inside the press main body 2. That is, each movable holding section 3 moves vertically between the inner wall of the press main body 2 and the side surface of the pressuring punch 1 with which the movable holding section 3 is in contact. However, since the movable holding sections 3, 3 are suspended by the resilient members 4, resiliencies developed by the resilient members 4 are applied downward to the movable holding sections 3, 3 when the more the holding sections are pushed upward. Each resilient member 4 is made of a resilient body such as a coil spring, a spring, a flat spring, rubber, and the like. A notch 5 is arranged at the bottom end of each movable holding section 3.

An operation of the movable holding section 3 will be described with reference to FIG. 2. A pressure terminal 105 has a connecting part 109 in a central portion thereof. The connecting part 109 has a pair of pressuring blades 102 in a direction of depth thereof. As the movable holding section 3 is lowered in association with the lowering of the press main body 2, the connecting part 109 of the pressure terminal 105 is fitted into the notches 5 thereof. Therefore, the lowering of the movable holding section 3 causes the connecting part 109 to be pressed downward, rectifying the floating condition of a part of the pressure terminal 105.

As shown in FIG. 4, the press main body 2 is set to a predetermined standby position together with the movable holding sections 3, before starting a press-fitting process, the predetermined standby position being above a wire 103 and the pressuring blades 102.

When the wire press-fitting process is started under this condition, the press main body 2 is lowered. As a result, the bottom ends of the movable holding sections 3, 3 suspended by the resilient members 4, 4 are abutted against the top ends of the pressuring blades 102, respectively. As the press main body 2 is further lowered, the resilient members 4, 4, being compressed, develop resiliencies. These resiliencies cause the bottom ends of the movable holding sections 3, 3 to strongly push the top ends of the pressuring blades 102, respectively, which in turn rectifies the floating condition of a part of the pressure terminal 105, should a part of the pressure terminal 105 be floating inside a housing 106.

When the press main body 2 is still further lowered with the pressure terminal 105 being pushed from above by the movable holding sections 3, 3 as described above, the horizontally extending long groove 7 at the bottom end of the pressuring punch 1 is abutted against the surface of the wire 103. When the press main body 2 is still further lowered under this condition, the groove 7 further pushes the wire 103 down to cause the lower portion of the sheath of the wire 103 to come in contact with the pressuring blades 102.

In association with the press main body 2 being still further lowered, the pressuring blades 102 cut the sheath of the wire 103 apart. At this instance, the pressuring blades 102 are inserted into the grooves 1*a* so that the press main body 2 does not interfere with the pressuring blades 102.

Therefore, as shown in FIG. 5, the wire press-fitting process is completed when conductors exposed from the wire 103 are pressed deep into the pressuring blades.

Figure 3:
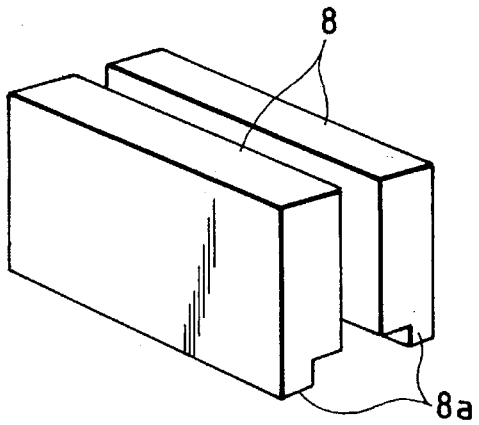
FIG. 3 is a perspective view of movable holding sections of a wire press-fitting apparatus, which is a second embodiment of the invention.
Figure 6:
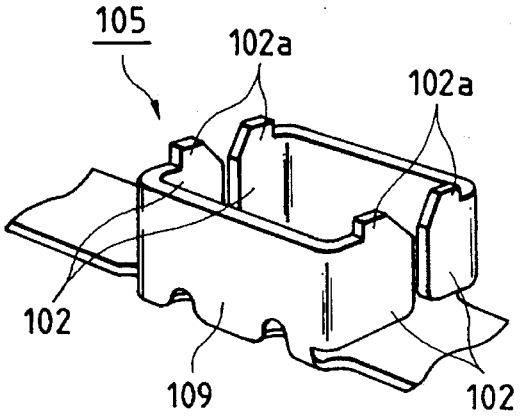
FIG. 6 is a perspective view showing a main portion of a pressure terminal applied to the second embodiment of the invention.
Figure 7:
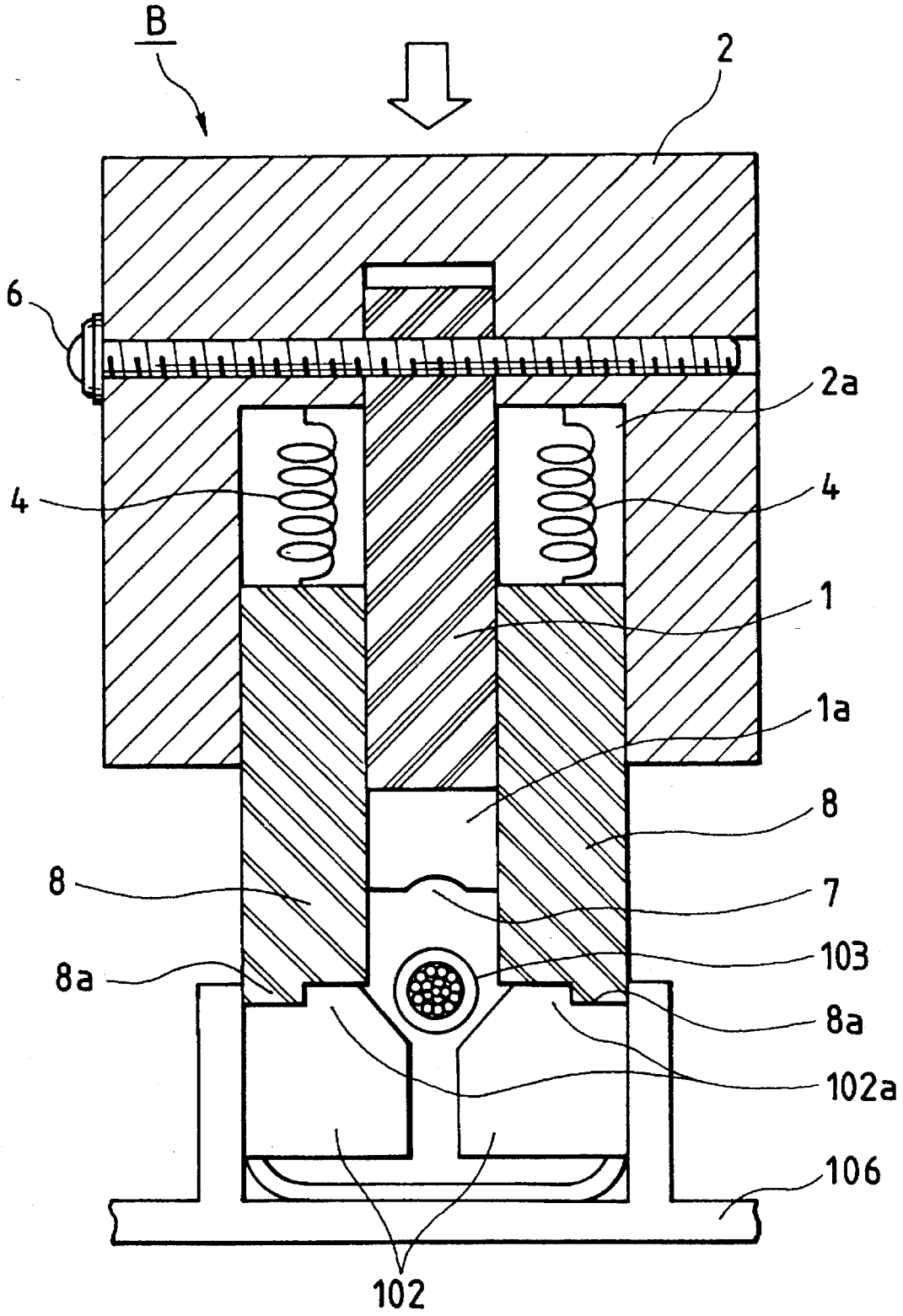
FIG. 7 is a diagram illustrative of an operation before a wire is pressured by the apparatus shown in FIG. 3.
Figure 8:
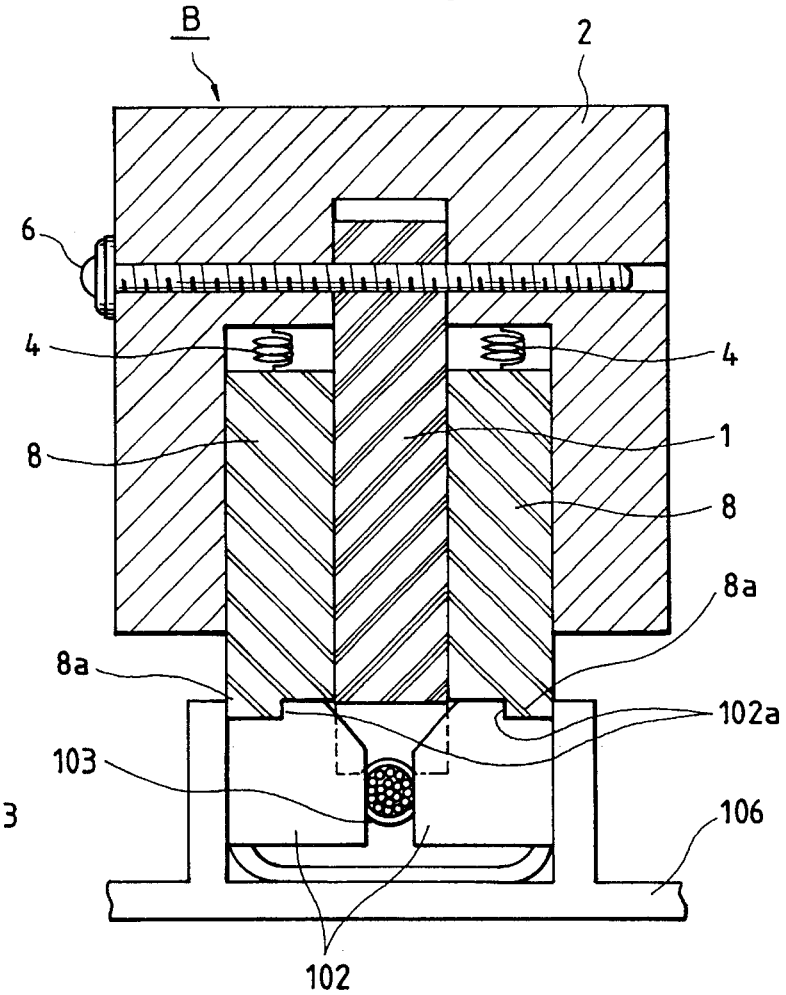
FIG. 8 is a diagram illustrative of an operation after the wire is pressured by the apparatus shown in FIG. 3.
Figure 9:
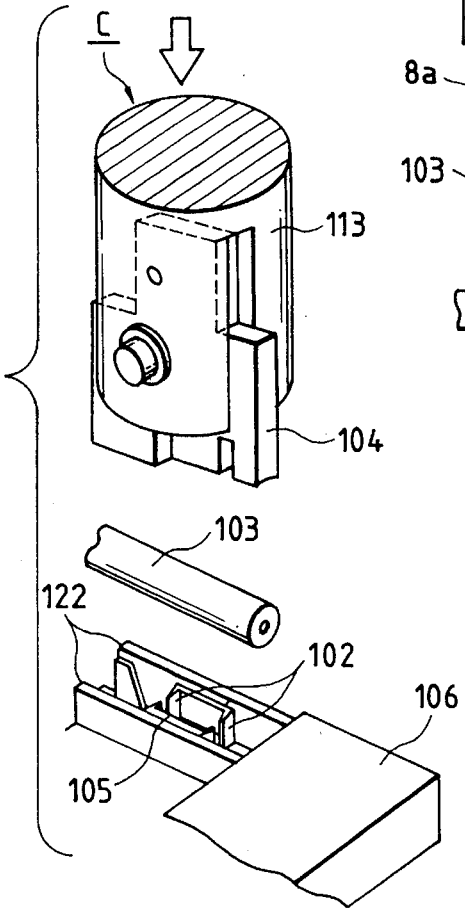
FIG. 9 is a perspective view showing a conventional wire press-fitting apparatus.
Figure 10:
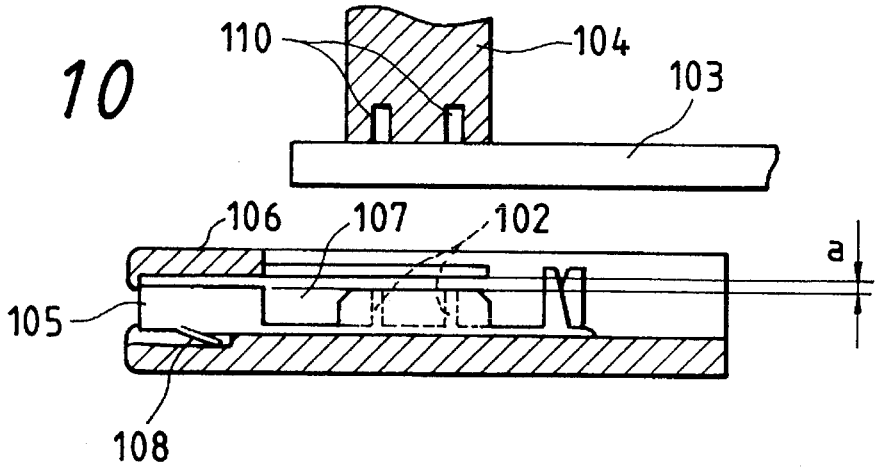
FIG. 10 is a diagram illustrative of an operation before a wire is pressured by the apparatus shown in FIG. 9.
Figure 11:
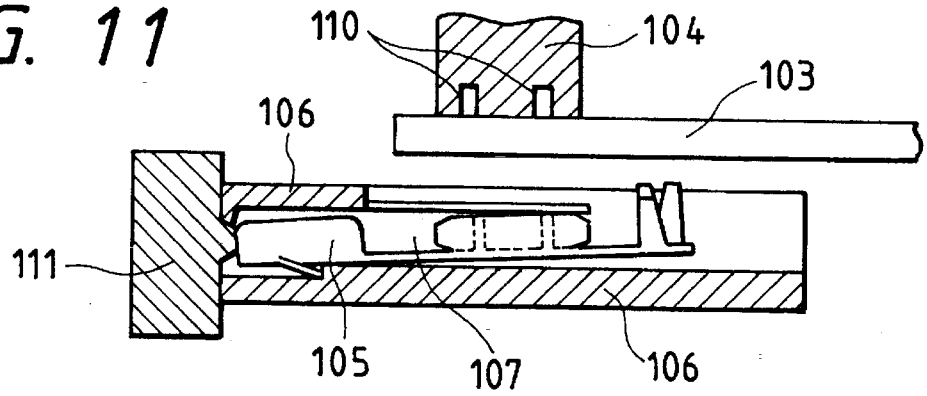
FIG. 11 is a diagram illustrative of an operation with a rear part of a pressure terminal in FIG. 9 in a floating state.
Figure 12:
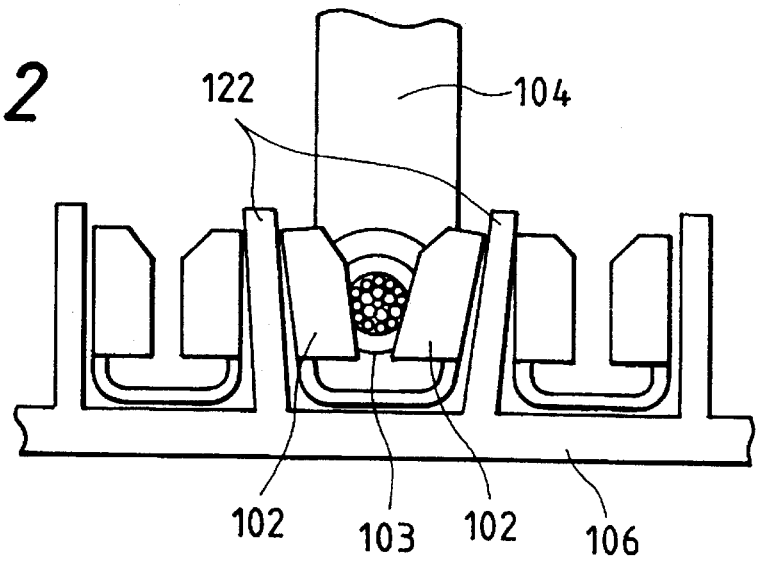
FIG. 12 is a diagram illustrative of an operation with the pressure terminal in FIG. 9 in an expanded state.

A wire press-fitting method and apparatus for a pressure terminal, which is a second embodiment of the invention, will be described next with reference to FIGS. 3, 6, 7, and 8. FIG. 3 is a perspective view of movable holding sections in the second embodiment; FIG. 6 is a perspective view showing a main portion of a pressure terminal applied to the second embodiment; FIG. 7 is a diagram illustrative of an operation before a wire is pressured by the second embodiment shown in FIG. 3; and FIG. 8 is a diagram illustrative of an operation after the wire is pressured by the second embodiment shown in FIG. 3.

As shown in FIG. 3, movable holding sections 8, 8 used in the second embodiment have projections 8*a*, 8*a* along the outer sides of the bottom ends thereof, respectively.

Further, as shown in FIG. 6, the connecting part 109 of the pressure terminal 105 used in the second embodiment is characterized as having acutely-angled stepped portions 102*a*, 102*a* formed on the top ends of two sets of pressuring blades 102, 102, each set of pressuring blades consisting of a pair of strips on the left and right sides. Each of these stepped portions 102*a* is designed to be stepped down on the outer side. The projections 8*a* of the movable holding sections 8 engage the top ends of the pressuring blades adjacent the stepped portions 102*a*, as shown in FIG. 7.

A press-fitting process of the second embodiment will be described next with reference to FIGS. 7 and 8.

As shown in FIG. 7, the platelike pressuring punch 1 is fitted into the vertically movable press main body 2 through the retaining shaft 6. Further, the respective platelike movable holding sections 8, 8 are disposed so as to interpose both side surfaces of the pressuring punch 1 while being urged downward by the resilient members 4, 4, one end of each resilient member being supported by the press main body 2. The projections 8*a*, 8*a* for forming such steps as to correspond to the stepped portions 102*a* of the pressuring blades 102 are provided on the outer sides of the bottom ends of the movable holding sections 8, 8, respectively.

Before starting the press-fitting process, the press main body 2 is set to a predetermined standby position above both the wire 103 and the pressuring blades 102 together with the pressuring punch 1 and the movable holding sections 8, 8.

Upon start of the wire press-fitting process under this condition, the press main body 2 is lowered, and this causes the bottom ends of the movable holding sections 8 suspended by the resilient members 4 to be abutted against the top ends of the pressuring blades 102, engaging the projections 8*a* of the movable holding sections 8 with the stepped portions 102*a* of the pressuring blades 102.

As the press main body 2 is further lowered as shown in FIG. 8, the resilient members 4 are compressed to thereby develop resiliencies. These resiliencies cause the bottom ends of the movable holding sections 8 to strongly push the top ends of the pressuring blades 102, which in turn reinforces the engagement between the stepped portions 102*a* and the projections 8*a*. Further, should a part of the pressure terminal 105 be floating, the position of the pressure terminal 105 is rectified and therefore fixed in a predetermined position.

As the press main body 2 is still further lowered after the engagement between the stepped portions 102*a* of the pressuring blades 102 and the projections 8*a* of the movable holding sections 8 has been reinforced, the horizontally extending long groove 7 at the bottom end of the pressuring punch 1 comes in contact with the surface of the wire 103.

When the press main body 2 is lowered under this condition, the horizontally extending long groove 7 at the bottom end of the pressuring punch 1 pushes the wire 103 further down and, as a result, the lower portion of the sheath of the wire 103 comes in contact with the pressuring blades 102. If the press main body 2 is still further lowered, the pressuring blades 102 cuts the sheath of the wire 103 apart, thereby not only starting pressing the wire 103 into the pressuring blades 102, but also causing a large outwardly expanding force to be exerted on both sides of each pressuring blade 102.

The expanding force exerted on the pressuring blades 102 at this instance is checked by the movable holding sections 8, 8 engaged with the stepped portions 102*a* of the pressuring blades 102.

Therefore, not only such plastic deformation as to open both side walls of each pressuring blade 102 apart from each other can be avoided, but also the conductors exposed from the wire 103 contact the pressuring blades 102 without fail so that a connection providing reliable electric conduction can be established.

As described above, it is the movable holding sections 8 that push the pressuring blades 102 from above over the whole wire press-fitting process, and it is the projections 8*a* of the movable holding sections 8 that reliably prevent the pressuring blades 102 from being deformed through the engagement thereof with the stepped portions 102*a* of the pressuring blades 102.

Therefore, the exposed conductors can be pressed deep into the pressuring blades 102, which in turn allows a connection providing highly reliable conduction to be established.

As described in the foregoing, the wire press-fitting method and apparatus for a pressure terminal of the invention as recited in claims 1 and 3 is so designed that the platelike pressuring punch is fitted into the vertically movable press main body through the retaining shaft, and that the respective platelike movable holding sections are disposed so as to interpose both side surfaces of the pressuring punch while urged by the resilient members, one end of each resilient member being supported by the press main body.

Therefore, the movable holding sections push the pressuring blades from above over the whole wire press-fitting process, which not only prevents incomplete connection and playing of the pressure terminal attributable to a part of the pressuring terminal floating or the like without fail, but also prevents deformation of the pressuring blades so that stable connection by pressure can be implemented.

Further, the wire press-fitting method and apparatus for a pressure terminal of the invention as recited in claims 2 and 4 is so designed that not only is the platelike pressuring punch fitted into the vertically movable press main body through the retaining shaft and the respective platelike movable holding sections are disposed so as to interpose both side surfaces of the pressuring punch while urged by the resilient members, one end of each resilient member being supported by the press main body, but also the movable holding portions include projections engage the stepped portions of the pressuring blades on the outer sides of the bottom ends of the movable holding sections.

Therefore, the movable holding sections push the pressuring blades from above over the whole wire press-fitting process, and the projections of the movable holding sections reliably prevent deformation, i.e., expansion of the pressuring blades through the engagement thereof with the stepped portions of the pressuring blades. As a result, defective connection attributable to deformation of the pressuring blades can be prevented, thereby allowing highly reliable wire pressure connection to be implemented.

What is claimed is:

1. A wire press-fitting method for a pressure terminal, comprising steps of:

lowering a press main body toward the pressure terminal, the press main body having a pressuring punch which is vertically movable therein, the pressure terminal having a wire positioned therein;

abutting bottom ends of movable holding sections against top ends of pressuring blades of the pressure terminal such that the pressuring blades are pushed down, wherein the movable holding sections are disposed along side surfaces of the pressuring punch and are urged by resilient members, one end of each resilient member being supported by the press main body; and pressing a wire into the pressuring blades of the pressure terminal by the pressuring punch from above to connect the wire with the pressure terminal for electrical conduction.

2. A wire press-fitting method for a pressure terminal, comprising steps of:

lowering a press main body toward the pressure terminal, the press main body having a pressuring punch which is vertically movable therein, the pressure terminal having a wire positioned therein;

engaging projections arranged on outer sides of bottom ends of movable holding sections with stepped portions arranged on top ends of pressuring blades of the pressure terminal such that the pressuring blades are pushed down and expansion of the pressuring blades is prevented, wherein the movable holding sections are disposed along side surfaces of the pressuring punch and are urged by resilient members, one end of each resilient member being supported by the press main body; and pressing a wire into pressuring blades of the pressure terminal by the pressuring punch from above to connect the wire with the pressure terminal for electrical conduction.

3. A wire press-fitting apparatus for a pressure terminal having pressuring blades, comprising:

a press main body which is vertically movable;

a platelike pressuring punch held in an opening of said press main body with a retaining shaft, said pressuring punch having in a bottom end thereof a horizontally extending long groove serving as a surface of abutment against a wire;

platelike movable holding sections for pushing down on top ends of the pressuring blades of the pressure terminal when the press main body is lowered, said holding sections being disposed along both side surfaces of the pressuring punch so as to be urged by resilient members, one end of each resilient member being supported by the press main body.

4. A wire press-fitting apparatus for a pressure terminal having pressing blades, said pressing blades having stepped portions arranged on top ends of the pressing blades, comprising:

a press main body which is vertically movable;

a platelike pressuring punch held in an opening of said press main body with a retaining shaft, said pressuring punch having in a bottom end thereof a horizontally extending long groove serving as a surface of abutment against a wire;

platelike movable holding sections disposed along both side surfaces of the pressuring punch so as to be urged by resilient members, one end of each resilient member being supported by the press main body;

projections arranged on outer sides of bottom ends of the movable holding sections for engaging the stepped portions of the pressure blades, pushing the pressuring blades down, and preventing outward expansion of the pressuring blades when the press main body is lowered.

5. A wire press-fitting apparatus as claimed in claim 3, further comprising notches centrally disposed in the movable sections for receiving a connecting part of the pressure terminal.

6. A wire press-fitting apparatus as claimed in claim 3, wherein said pressuring punch further includes grooves for receiving the pressuring blades when the pressuring blades cut the wire.

* * * * *